US006946056B2

(12) United States Patent
Ragnar

(10) Patent No.: US 6,946,056 B2
(45) Date of Patent: Sep. 20, 2005

(54) METHOD FOR REGULATING THE MANUFACTURING OF PULP BY OPTICALLY MEASURING THE AMOUNT OF HEXENURONIC ACID

(75) Inventor: Martin Ragnar, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 326 days.

(21) Appl. No.: 10/275,939

(22) PCT Filed: May 30, 2001

(86) PCT No.: PCT/SE01/01200

§ 371 (c)(1),
(2), (4) Date: Nov. 8, 2002

(87) PCT Pub. No.: WO01/92635

PCT Pub. Date: Dec. 6, 2001

(65) Prior Publication Data

US 2003/0178164 A1 Sep. 25, 2003

(51) Int. Cl.[7] ..... D21C 7/12

(52) U.S. Cl. ..... 162/49; 162/61; 162/76; 73/53.03; 436/164; 436/171

(58) Field of Search ..... 73/53.03; 436/164, 436/171; 162/49, 198, 61, 62, 76

(56) References Cited

U.S. PATENT DOCUMENTS 3,764,463 A * 10/1973 Histed et al. ..... 162/49
4,013,506 A * 3/1977 Histed et al. ..... 162/49
4,086,129 A * 4/1978 Conca et al. ..... 162/49
4,886,576 A * 12/1989 Sloan ..... 162/49
5,378,320 A * 1/1995 Leclerc et al. ..... 162/49
6,229,612 B1 * 5/2001 Koo ..... 356/433
6,776,876 B1 * 8/2004 Vuorinen et al. ..... 162/65

FOREIGN PATENT DOCUMENTS

SE WO 96/12063 * 4/1996

* cited by examiner

*Primary Examiner*—Steve Alvo
(74) *Attorney, Agent, or Firm*—Rolf Fasth Fasth Law Offices

(57) ABSTRACT

Method for enabling the paper pulp production process to be controlled in such a way that the hexenuronic acid content in the pulp can be minimized and the color reversion of the pulp and/or the pulp products thereby minimized. The method is based on measurements of the optical properties of a fiber containing substance or process stream in the wavelength region 232±5 nm and another wavelength interval. A significant value for the current hexenuronic acid content is formed by correcting the intensity in the spectrum around 232 nm by the corresponding optical quantity at the other wavelength interval. The content of the hexenuronic acid content that is determined by the analysis is then used for controlling conditions in the process stage.

8 Claims, 1 Drawing Sheet

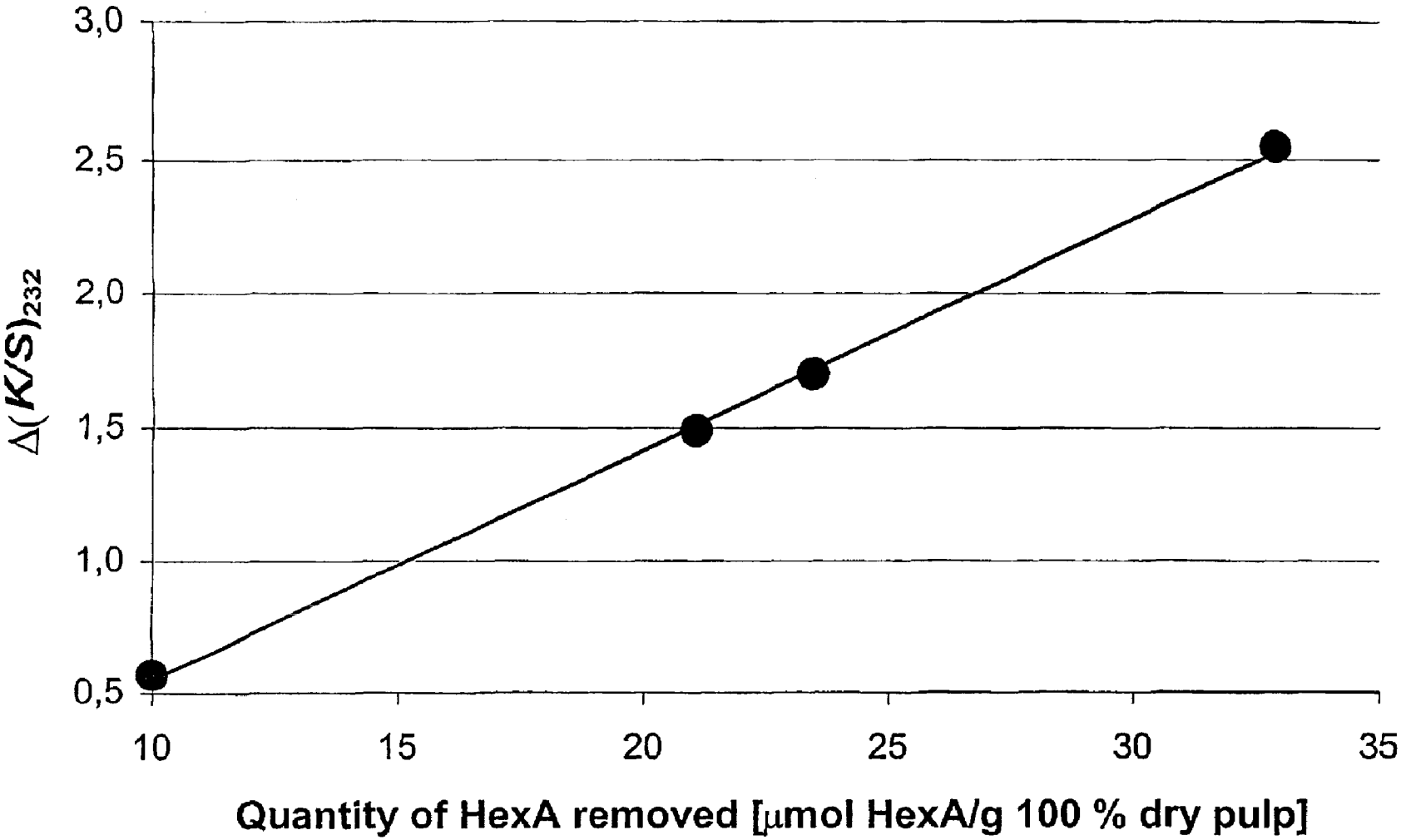
3,0
2,5
2,0
1,5
1,0
0,5
Δ(K/S)232
10
15
20
25
30
35
Quantity of HexA removed [μmol HexA/g 100 % dry pulp]

METHOD FOR REGULATING THE MANUFACTURING OF PULP BY OPTICALLY MEASURING THE AMOUNT OF HEXENURONIC ACID

PRIOR APPLICATION

This application is a U.S. national phase application based on International Application No. PCT/SE01/01200, filed 30 May 2001, claiming priority from Swedish Patent Application No. 0002047-9, filed 31 May 2000.

TECHNICAL FIELD

The invention relates to a method for regulating a process for manufacturing paper pulp in which the content of hexenuronic acid in the paper pulp is determined during the manufacture of the paper pulp.

BACKGROUND AND SUMMARY OF THE INVENTION

Paper is a material which has many areas of application. The demand for different papers, and consequently for their principal raw material paper pulp, are therefore very variable. The optical properties of the paper, such as its colour, are very important in many application areas. It can be mentioned that the paper pulp is sometimes stained blue in order to deceive the eye into believing that the paper is whiter, i.e. less yellow, than it in fact is.

The optical properties of a paper pulp are altered during the course of the production process when the wood is cooked in order to expose the fibres and during bleaching. To a large extent, this is due to the breakdown and removal of colouring and light-absorbing structures (chromophores) in the wood, such as lignin and certain carbohydrates and the breakdown and hydrolysis products of these substances.

Some of these unwanted structures are always left in the paper pulp after cooking and have to be attacked in the subsequent bleaching. Apart from lignin, another important structure, namely the so-called hexenuronic acid (also termed HexA below) has attracted ever-increasing interest in recent years since it has been shown that when this acid is left in the paper pulp, and hence the paper, it can inter alia cause colour reversion, i.e. meaning that the paper becomes yellower as it ages.

Methods for reducing colour reversion caused by breakdown products which have not been washed out were presented at an early stage in SE225253, which presented acidic and basic treatments. Treatment in an acidic medium (pH of about 3) and for a relatively long period (2 hours), and at a high temperature (80-120 degrees), has been found to result in substantial reductions in the colour reversion of the pulp.

HexA has its origin in the xylan of the native wood, with xylan being a polymer which occurs with a particularly high degree of frequency in hard wood. HexA is a carbohydrate structure which, using more rational nomenclature, can be designated 4-deoxy-β-L-threo-4-enopyranosyluronic acid. It is not present as a native component in the wood but is instead formed during alkaline paper pulp production form the 4-O-methylglucuronic acid structure which is bonded to the xylan.

Methods for decreasing the content of HexA by treating paper pulp are known, see, for example, T. Vuorinen et al. Selective Hydrolysis of Hexenuronic Acid Groups and its Application in ECF and TCF Bleaching of Kraft Pulps; J. Pulp Paper Science 25(5): 155–162 (1999). It is also well known that chlorine dioxide and ozone, inter alia, react with HexA during bleaching. However, it is also known that the frequently employed bleaching chemicals oxygen and hydrogen peroxide, for example, do not decompose HexA. It has not hitherto been possible to measure, in any simple and automated manner, to what degree precisely HexA is attacked by different chemicals in connection with industrial pulp production, and it has not therefore been possible to follow the reduction of HexA in any controlled manner, to the detriment of optimizing process conditions which are selected in the bleaching department. Instead, it has been necessary to rely on the very vague concept of kappa number, which does not differentiate between lignin and HexA.

Since there are no simple and rapid methods for analysing HexA, it is difficult, during industrial operation, to optimize and control the process with a view to decreasing the quantity of HexA over one or more process stages, for example by varying the pH, the temperature and the quantities of chemicals added. Without any doubt, this makes it more difficult to manufacture a product which is both bright and brightness-stable.

As a rule, methods for analysing HexA which have been described to date require some form of preliminary hydrolysis, which can comprise treating with acid in a pressure vessel at high temperatures (T. Vuorinen et al.; Selective Hydrolysis of Hexenuronic Acid Groups in ECF and TCF Bleaching of Kraft Pulps, *International Pulp Bleaching Conference*, Washington D.C., USA 1996, Vol. I 42–51), swelling the pulp for several hours, followed by treating with mercuric acetate solutions (G Gellerstedt; Li, J; An HPLC Method for the Quantitative Determination of Hexenuronic Acid Groups in Chemical Pulps, *Carbohydr. Res.* 1996, 294 41–51); or various time-consuming enzymic treatments (M Tenkanen et al.; Use of Enzymes in Combination with Anion Exchange Chromatography in the Analysis of Carbohydrate Composition of Kraft Pulps, 8$^{th}$ *International Symposium on Wood and Pulping Chemistry*, Helsinki, Finland 1995, Vol. III 189–194); (A Rydlund; Dahlman, O; Rapid Analysis of Unsaturated Acidic Xylooligosaccharides from Kraft Pulps using Capillary Zone Electrophoresis (CZE), *J. High. Resolut. Chromatogr.* 1997, 20 (2), 72–76). The chemical methods give relatively rapid hydrolysis and in the main use UV spectrophotometry (T. Vuorinen et al., 1996) or HPLC (G Gellerstedt and Li, J.; 1996) for the subsequent analysis. The structures which are analysed are in actual fact various breakdown products which are derived from the HexA structure but which can vary depending on the method by which the HexA has been broken down or hydrolysed. Thus, it is not possible, for example, to study the content of a particular given breakdown product derived from HexA in the liquid phase from different bleaching stages and correlate this directly against the quantity of HexA which has been broken down. The reaction products differ greatly from each other depending on whether the breakdown has taken place by means of acidic hydrolysis, ozonolysis or reaction with chlorine dioxide, for example. Because of either nonspecific breakdown products, complicated analytical methods, the amount of time required or complicated equipment, none of the abovementioned analytical methods is suitable, or even possible, to apply for at-line studies of the removal of HexA in a bleaching department.

From a purely theoretical point of view, a simple analytical method ought to be that of directly determining the HexA in the pulp spectrophotometrically since HexA has a specific absorption peak at 232 nm. It ought therefore to be possible to exploit this for quantitatively determining HexA. However, other structures in the pulp, of which the foremost is lignin, also absorb strongly at this wavelength. It is not therefore possible to use spectrophotometry directly for determining HexA at this particular wavelength.

The purpose of the invention is to offer a simplified method for determining the decrease (change) in the quantity of HexA in paper pulp or paper between different measurement sites or at different measurement times in order, thereby, to be able to carry out continuous monitoring of, and adjustments to, the manufacturing process during its course. This then makes it possible to control the process and to optimize different process variables in order to eliminate, or substantially decrease, the quantity of HexA with the aim of improving pulp quality and the cost-effectiveness of the operation.

The method according to the invention is based on optical measurements of the absorbance, reflectance, transmittance or similar optical property of pulp suspensions at at least two different wavelengths and in such a way that the measurement of the optical property in the wavelength region around 232 nm, which is characteristic for HexA, is decreased by the value of the optical property in a wavelength region which corresponds to the absorbance of other chromophores, such as lignin, which are present, for example in the region around 280 or 205 nm (if the quantity is not additive per se, it is firstly converted into an additive quantity). Measurements can also be performed in the whole wavelength range for the purpose of multivariant assessment. In every case, use is made of the differences between two different pulp suspensions which are respectively removed before and after the treatment (for example bleaching) whose effect on the content of HexA it is wished to study. Thus, if it is decided to use only two different wavelengths for the calculation, the quantity of HexA which is removed over a given bleaching stage can be determined in accordance with the following formula:

$$\Delta HexA = k[(A_{232}-A_{280})_{entering}-(A_{232}-A_{280})_{leaving}]$$

where k is a proportionality constant and the A values are the absorbance, or some other additive optical quantity, at the given wavelength, measured either directly or calculated from some known relationship, such as the Kubelka-Munk relationship.

Additional features and aspects, and also advantages, of the invention will be evident from the subsequent patent claims and the following example.

Pulps having different contents of HexA were produced by means of the acidic hydrolysis of an oxygen-delignified kraft hardwood pulp, with the pulp being treated in stainless steel autoclaves for 60 minutes at 85, 95, 100 and 110° C. The autoclaves were maintained at a pressure of 8 bar using nitrogen. The pH was adjusted to 3.2 by adding sulphuric acid. This acid treatment of the pulp is selective with respect to HexA as far as structures which are of importance to the method are concerned.

The pulps were disintegrated in accordance with the SCAN-test method SCAN C 18:65, 1964: Disintegration of Chemical Pulp for Testing. Laboratory sheets were manufactured in accordance with the SCAN-test method: SCAN CM 11:95, 1995: Preparation of Laboratory Sheets (Optical Properties). When using this standard method, the pH of the pulp suspension was adjusted to 5±0.3 in order to provide standardized conditions. The laboratory sheets were made using a sheet moulder and not using a funnel, which is an alternative according to the standard method. The grammage of the sheets was 60 g/m$^2$, which is not in agreement with the standard method but which was necessary in order to meet the requirements for the Kubelka-Munk theory to be applicable. Three sheets were made in the case of each pulp and each sheet was cut into several pieces which were placed one on top of the other in a pile such that it was possible to use the rough side for measurements in diffuse, reflected light. The measurements on these sheet piles were performed using a Varian Cary 100 spectrophotometer equipped with an attachment for measuring in diffuse, reflected light, and the $\Delta(K/S)_{corrected}$ was calculated using the formulae $$\frac{K}{S} = \frac{(1-R_{[illegible]})^2}{2R_{[illegible]}}$$

and $$\Delta(K/S)_{corrected} = \Delta(K/S)_{232\ nm} - \Delta(K/S)_{280}\ \text{nm}$$

where K/S is assumed to be proportional to the chromophore concentration due to the fact that the change in the scattering coefficient S through the bleaching department can be considered to be negligible.

In order to evaluate the validity of the above relationship, the liquid from each autoclave was collected, together with the filtrate and the washing liquid from the pulp, and the solution was diluted to 2.0 litres in a measuring cylinder. Quantitative analyses of HexA in this liquid were performed as described by Vuorinen at al. (T Vuorinen et al.; Selective Hydrolysis of Hexenuronic Acid Groups in ECF and TCF Bleaching of Kraft Pulps, *International Pulp Bleaching Conference*, Washington D.C., U.S.A. 1996, Vol. I 42–51). Since the above acid treatment of the pulp is selected with respect to HexA, there should be a good correlation between the change in the content of HexA as measured by the method described by Vuorinen et al. And by means of the abovementioned measurements and calculations of $\Delta(K/S)_{corrected}$, which proves to be the case. The above relationship is therefore valid.

The differences between the example and the form which it is hereby sought to patent lie in the physical performance of the measurement, with the method which it is sought to patent being based on measurements using the type of optical instruments which have for several years been located in many mills for the purpose of determining kappa number at-line or on-line.

The method according to the invention provides a procedure where it is possible, in a feed-back manner, to optimize the process with regard to reducing hexenuronic acid. The process conditions such as temperature, acid composition, addition of chemicals, dwell time or pressure can then be adjusted such that the desired reduction is obtained. This approach can be applied irrespective of the type of process stage, which can be an A stage (acid stage), D stage (chlorine dioxide stage), Z stage (ozone stage), C stage (chlorine stage), Paa stage (peracetic acid stage), Ca stage (Caros acid stage) or another stage where the conditions lead to a reduction in hexenuronic acid.

The invention relates to a method for regulating a process for manufacturing paper pulp in which the content of hexenuronic acid in the paper pulp is determined during the manufacture of the paper pulp.

Paper is a material which has many areas of application. The demand for different papers, and consequently for their principal raw material paper pulp, are therefore very variable. The optical properties of the paper, such as its colour, are very important in many application areas. It can be mentioned that the paper pulp is sometimes stained blue in order to deceive the eye into believing that the paper is whiter, i.e. less yellow, than it in fact is.

The optical properties of a paper pulp are altered during the course of the production process when the wood is cooked in order to expose the fibres and during bleaching. To a large extent, this is due to the breakdown and removal of colouring and light-absorbing structures (chromophores) in the wood, such as lignin and certain carbohydrates and the breakdown and hydrolysis products of these substances.

Some of these unwanted structures are always left in the paper pulp after cooking and have to be attacked in the subsequent bleaching. Apart from lignin, another important structure, namely the so-called hexenuronic acid (also termed HexA below) has attracted ever-increasing interest in recent years since it has been shown that when this acid is left in the paper pulp, and hence the paper, it can inter alia cause colour reversion, i.e. meaning that the paper becomes yellower as it ages.

Methods for reducing colour reversion caused by breakdown products which have not been washed out were presented at an early stage in SE225253, which presented acidic and basic treatments. Treatment in an acidic medium (pH of about 3) and for a relatively long period (2 hours), and at a high temperature (80–120 degrees), has been found to result in substantial reductions in the colour reversion of the pulp.

HexA has its origin in the xylan of the native wood, with xylan being a polymer which occurs with a particularly high degree of frequency in hard wood. HexA is a carbohydrate structure which, using more rational nomenclature, can be designated 4-deoxy-β-L-threo-4-enopyranosyluronic acid. It is not present as a native component in the wood but is instead formed during alkaline paper pulp production from the 4-O-methylglucuronic acid structure which is bonded to the xylan.

Methods for decreasing the content of HexA by treating paper pulp are known, see, for example, T. Vuorinen et al. Selective Hydrolysis of Hexenuronic Acid Groups and its Application in ECF and TCF Bleaching of Kraft Pulps; J. Pulp Paper Science 25(5): 155–162 (1999). It is also well known that chlorine dioxide and ozone, inter alia, react with HexA during bleaching. However, it is also known that the frequently employed bleaching chemicals oxygen and hydrogen peroxide, for example, do not decompose HexA. It has not hitherto been possible to measure, in any simple and automated manner, to what degree precisely HexA is attacked by different chemicals in connection with industrial pulp production, and it has not therefore been possible to follow the reduction of HexA in any controlled manner, to the detriment of optimizing process conditions which are selected in the bleaching department. Instead, it has been necessary to rely on the very vague concept of kappa number, which does not differentiate between lignin and HexA.

Since there are no simple and rapid methods for analysing HexA, it is difficult, during industrial operation, to optimize and control the process with a view to decreasing the quantity of HexA over one or more process stages, for example by varying the pH, the temperature and the quantities of chemicals added. Without any doubt, this makes it more difficult to manufacture a product which is both bright and brightness-stable.

As a rule, methods for analysing HexA which have been described to date require some form of preliminary hydrolysis, which can comprise treating with acid in a pressure vessel at high temperatures (T. Vuorinen et al.; Selective Hydrolysis of Hexenuronic Acid Groups in ECF and TCF Bleaching of Kraft Pulps, *International Pulp Bleaching Conference*, Washington D.C., USA 1996, Vol. I 42–51), swelling the pulp for several hours, followed by treating with mercuric acetate solutions (G Gellerstedt; Li, J; An HPLC Method for the Quantitative Determination of Hexenuronic Acid Groups in Chemical Pulps, *Carbohydr. Res.* 1996, 294 41–51), or various time-consuming enzymic treatments (M Tenkanen et al.; Use of Enzymes in Combination with Anion Exchange Chromatography in the Analysis of Carbohydrate Composition of Kraft Pulps, 8$^{th}$ *International Symposium on Wood and Pulping Chemistry*, Helsinki, Finland 1995, Vol. III 189–194); (A Rydlund; Dahlman, O; Rapid Analysis of Unsaturated Acidic Xylooligosaccharides from Kraft Pulps using Capillary Zone Electrophoresis (CZE), *J. High. Resolut. Chromatogr.* 1997, 20 (2), 72–76). The chemical methods give relatively rapid hydrolysis and in the main use UV spectrophotometry (T Vuorinen et al., 1996) or HPLC (G Gellerstedt and Li, J.; 1996) for the subsequent analysis. The structures which are analysed are in actual fact various breakdown products which are derived from the HexA structure but which can vary depending on the method by which the HexA has been broken down or hydrolysed. Thus, it is not possible, for example, to study the content of a particular given breakdown product derived from HexA in the liquid phase from different bleaching stages and correlate this directly against the quantity of HexA which has been broken down. The reaction products differ greatly from each other depending on whether the breakdown has taken place by means of acidic hydrolysis, ozonolysis or reaction with chlorine dioxide, for example. Because of either nonspecific breakdown products, complicated analytical methods, the amount of time required or complicated equipment, none of the abovementioned analytical methods is suitable, or even possible, to apply for at-line studies of the removal of HexA in a bleaching department.

From a purely theoretical point of view, a simple analytical method ought to be that of directly determining the HexA in the pulp spectrophotometrically since HexA has a specific absorption peak at 232 nm. It ought therefore to be possible to exploit this for quantitatively determining HexA. However, other structures in the pulp, of which the foremost is lignin, also absorb strongly at this wavelength. It is not therefore possible to use spectrophotometry directly for determining HexA at this particular wavelength.

BRIEF DESCRIPTION OF THE DRAWING

FIG. 1 is a schematic view showing the linear relationship between the quantity of the removed HexA and $\Delta K/S_{232}$.

DETAILED DESCRIPTION

The purpose of the invention is to offer a simplified method for determining the decrease (change) in the quantity of HexA in paper pulp or paper between different measurement sites or at different measurement times in order, thereby, to be able to carry out continuous monitoring of, and adjustments to, the manufacturing process during its course. This then makes it possible to control the process and to optimize different process variables in order to eliminate, or substantially decrease, the quantity of HexA with the aim of improving pulp quality and the cost-effectiveness of the operation. This aim is achieved by means of a method as described in the characterizing part of Patent claim 1.

The method according to the invention is based on optical measurements of the absorbance, reflectance, transmittance or similar optical property of pulp suspensions at at least two different wavelengths and in such a way that the measurement of the optical property in the wavelength region around 232 nm, which is characteristic for HexA, is decreased by the value of the optical property in a wavelength region which corresponds to the absorbance of other chromophores, such as lignin, which are present, for example in the region around 280 or 205 nm (if the quantity is not additive per se, it is firstly converted into an additive quantity). Measurements can also be performed in the whole wavelength range for the purpose of multivariant assessment. In every case, use is made of the differences between two different pulp suspensions which are respectively removed before and after the treatment (for example bleaching) whose effect on the content of HexA it is wished to study. Thus, if it is decided to use only two different wavelengths for the calculation, the quantity of HexA which is removed over a given bleaching stage can be determined in accordance with the following formula:

$$\Delta HexA = k[(A_{232}-A_{280})_{entering}-(A_{232}-A_{280})_{leaving}]$$

where k is a proportionality constant and the A values are the absorbance, or some other additive optical quantity, at the given wavelength, measured either directly or calculated from some known relationship, such as the Kubelka-Munk relationship.

Additional features and aspects, and also advantages, of the invention will be evident from the subsequent patent claims and the following example.

Pulps having different contents of HexA were produced by means of the acidic hydrolysis of an oxygen-delignified kraft hardwood pulp, with the pulp being treated in stainless steel autoclaves for 60 minutes at 85, 95, 100 and 110° C. The autoclaves were maintained at a pressure of 8 bar using nitrogen. The pH was adjusted to 3.2 by adding sulphuric acid. This acid treatment of the pulp is selective with respect to HexA as far as structures which are of importance to the method are concerned.

The pulps were disintegrated in accordance with the SCAN-test method SCAN C 18:65, 1964: Disintegration of Chemical Pulp for Testing. Laboratory sheets were manufactured in accordance with the SCAN-test method: SCAN CM 11:95, 1995: Preparation of Laboratory Sheets (Optical Properties). When using this standard method, the pH of the pulp suspension was adjusted to 5±0.3 in order to provide standardized conditions. The laboratory sheets were made using a sheet moulder and not using a funnel, which is an alternative according to the standard method. The grammage of the sheets was 60 g/m$^2$, which is not in agreement with the standard method but which was necessary in order to meet the requirements for the Kubelka-Munk theory to be applicable. Three sheets were made in the case of each pulp and each sheet was cut into several pieces which were placed one on top of the other in a pile such that it was possible to use the rough side for measurements in diffuse, reflected light. The measurements on these sheet piles were performed using a Varian Cary 100 spectrophotometer equipped with an attachment for measuring in diffuse, reflected light, and the $\Delta(K/S)_{corrected}$ was calculated using the formulae $$\frac{K}{S} = \frac{(1 - R_{[illegible]})^2}{2R_{[illegible]}}$$

and $$\Delta(K/S)_{corrected} = \Delta(K/S)_{232\ nm} - \Delta(K/S)_{280\ \mathrm{nm}}$$

where K/S is assumed to be proportional to the chromophore concentration due to the fact that the change in the scattering coefficient S through the bleaching department can be considered to be negligible.

In order to evaluate the validity of the above relationship, the liquid from each autoclave was collected, together with the filtrate and the washing liquid from the pulp, and the solution was diluted to 2.0 litres in a measuring cylinder. Quantitative analyses of HexA in this liquid were performed as described by Vuorinen at al. (T Vuorinen et al.; Selective Hydrolysis of Hexenuronic Acid Groups in ECF and TCF Bleaching of Kraft Pulps, *International Pulp Bleaching Conference*, Washington D.C., U.S.A. 1996, Vol. I 42–51). Since the above acid treatment of the pulp is selected with respect to HexA, there should be a good correlation between the change in the content of HexA as measured by the method described by Vuorinen et al. And by means of the abovementioned measurements and calculations of $\Delta(K/S)_{corrected}$, which proves to be the case (FIG. 1). The above relationship is therefore valid.

The differences between the example and the form which it is hereby sought to patent lie in the physical performance of the measurement, with the method which it is sought to patent being based on measurements using the type of optical instruments which have for several years been located in many mills for the purpose of determining kappa number at-line or on-line.

The method according to the invention provides a procedure where it is possible, in a feed-back manner, to optimize the process with regard to reducing hexenuronic acid. The process conditions such as temperature, acid composition, addition of chemicals, dwell time or pressure can then be adjusted such that the desired reduction is obtained. This approach can be applied irrespective of the type of process stage, which can be an A stage (acid stage), D stage (chlorine dioxide stage), Z stage (ozone stage), C stage (chlorine stage), Paa stage (peracetic acid stage), Ca stage (Caros acid stage) or another stage where the conditions lead to a reduction in hexenuronic acid. While the present invention has been described in accordance with preferred compositions and embodiments, it is to be understood that certain substitutions and alterations may be made thereto without departing from the spirit and scope of the following claims.

What is claimed is:

1. A method for regulating a process for manufacturing paper pulp, where the content of hexenuronic acid in the paper pulp is determined during manufacture of the paper pulp comprising:

obtaining a current proportion of the hexenuronic acid in a substance obtained from a process stage, the substance containing at least a portion of pulp fibers that have passed through the process stage;

determining the current proportion of the hexenuronic acid by optical spectral analysis by measuring the hexenuronic acid at a first wavelength of about 232 nanometers to obtain a significant value of hexenuronic acid;

measuring a second substance at a second wavelength, the second wavelength being different from the first wavelength:

correcting the significant value by analyzing optical properties of the second wavelength to obtain a corrected significant value;

controlling conditions in the process for manufacturing the paper pulp based on the corrected significant value of the hexenuronic acid; and performing the optical analysis both before and after the process stage, between different measurement points and the change in the intensity in the spectrum around 232 nm between these measurement points or measurement times is used to control conditions in the process stage from which the pulp is obtained.

2. The method according to claim 1 wherein the method further comprises performing the optical measurements at least two different wavelengths and differences in some additive optical quantity between before and after a given treatment are calculated, and where the change in question is proportional to the quantity of HexA.

3. The method according to claim 2 wherein the method further comprises determining a correction by measuring the additive optical property for directly determining the hexenuronic acid content, where a correction term for the correction is determined by optically measuring with dominance around at least one of the wavelengths 205 nm or 280 nm.

4. The method according to claim 2 wherein the method further comprises determining the change in the hexenuronic acid content in accordance with the formula:

$$\Delta HexA = k[\Delta X_{232\pm5\ nm} - \Delta X_{205\pm5\ nm\ or\ 280\pm5\ nm}]$$

where X denotes a given additive optical quantity and k is a proportionality constant.

5. The method according to claim 1 wherein the method further comprises performing the optical measurements in a suspension of paper pulp.

6. The method according to claim 1 wherein the method further comprises performing the optical measurements on webs or sheets of paper pulp.

7. The method according to claim 1 wherein the method further comprises producing the paper pulp from hard wood.

8. The method according to claim 1 wherein the method further comprises adjusting at least one of the process parameters dwell time, temperature, pressure, chemical addition or acid addition depending upon a result from an optical analysis.

* * * * *